US009070970B2

(12) United States Patent
Kubo et al.

(10) Patent No.: US 9,070,970 B2
(45) Date of Patent: Jun. 30, 2015

(54) ANTENNA DEVICE AND MOBILE TERMINAL

(75) Inventors: Hiroyuki Kubo, Kyoto-fu (JP); Hiromitsu Ito, Kyoto-fu (JP); Kuniaki Yosui, Kyoto-fu (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 250 days.

(21) Appl. No.: 13/532,595

(22) Filed: Jun. 25, 2012

(65) Prior Publication Data

US 2012/0262348 A1 Oct. 18, 2012

Related U.S. Application Data

(63) Continuation of application No. PCT/JP2010/070768, filed on Nov. 22, 2010.

(30) Foreign Application Priority Data

Dec. 24, 2009 (JP) ..... 2009-291874

(51) Int. Cl.
*H01Q 1/24* (2006.01)
*H01Q 7/06* (2006.01)
*H01Q 1/22* (2006.01)

(52) U.S. Cl.
CPC ..... *H01Q 7/06* (2013.01); *H01Q 1/2216* (2013.01); *H01Q 1/242* (2013.01)

(58) Field of Classification Search
USPC ..... 343/702, 788, 700 MS
See application file for complete search history.

(56) References Cited

U.S. PATENT DOCUMENTS

| | | | | |
|---|---|---|---|---|
| 7,050,007 | B2 * | 5/2006 | Akiho et al. | 343/702 |
| 7,050,077 | B2 * | 5/2006 | Inoue et al. | 345/698 |
| 7,088,304 | B2 * | 8/2006 | Endo et al. | 343/788 |
| 8,718,727 | B2 * | 5/2014 | Kubo et al. | 455/575.7 |
| 2001/0011012 | A1 | 8/2001 | Hino et al. | |
| 2007/0229369 | A1 | 10/2007 | Platz | |
| 2007/0252763 | A1 | 11/2007 | Martin | |

FOREIGN PATENT DOCUMENTS

| | | | |
|---|---|---|---|
| CN | 1468468 | A | 1/2004 |
| EP | 1477927 | A1 | 11/2004 |

(Continued)

OTHER PUBLICATIONS

The First Office Action issued by the State Intellectual Property Office of People's Republic of China on Aug. 20, 2013, which corresponds to Chinese Patent Application No. 201080031554.8 and is related to U.S. Appl. No. 13/532,595; with translation.

(Continued)

*Primary Examiner* — Hoang V Nguyen
*Assistant Examiner* — Hai Tran
(74) *Attorney, Agent, or Firm* — Studebaker & Brackett PC

(57) ABSTRACT

This disclosure provides an antenna device and a mobile terminal equipped with the antenna device. The antenna device includes a coil conductor spirally wound to have a conductor opening portion at the center of winding and is formed on a flexible substrate. A magnetic sheet is disposed near, or proximal to the flexible substrate and between the coil conductor and a flat conductor of a circuit board. A side of the antenna coil that is near an edge of the flat conductor is bent toward the circuit board.

18 Claims, 7 Drawing Sheets

(56) References Cited

FOREIGN PATENT DOCUMENTS

| | | | |
|---|---|---|---|
| EP | 2482382 | A1 | 8/2010 |
| JP | 06-029215 | | 4/1994 |
| JP | 10-242742 | A | 9/1998 |
| JP | 2001-209767 | A | 8/2001 |
| JP | 2003-108966 | A | 4/2003 |
| JP | 2004-266811 | A | 9/2004 |
| JP | 2007-524942 | A | 8/2007 |
| JP | 2008-022469 | A | 1/2008 |
| JP | 2008-28642 | A | 2/2008 |
| JP | 2008-092131 | A | 4/2008 |
| JP | 2008-92131 | A | 4/2008 |
| WO | 02/29988 | A1 | 4/2002 |
| WO | 2009/078214 | A1 | 6/2009 |
| WO | 2009/090995 | A1 | 7/2009 |

OTHER PUBLICATIONS

The examination report issued by the United Kingdom Patent Office on Nov. 25, 2013, which corresponds to GB1200446.1 and is related to U.S. Appl. No. 13/532,595.

The Second Office Action issued by the State Intellectual Property Office of People's Republic of China on Apr. 30, 2014, which corresponds to Chinese Patent Application No. 201080031554.8 and is related to U.S. Appl. No. 13/532,595; with English language translation.

Written Opinion of the International Searching Authority; PCT/JP2010/070768; Feb. 22, 2011.

International Search Report; PCT/JP2010/070768; Feb. 22, 2011.

An Examination Report issued by the United Kingdom Patent Office on Jun. 23, 2014, which corresponds to United Kingdom Patent Application No. 1200446.1 and is related to U.S. Appl. No. 13/532,595.

The third Office Action issued by the State Intellectual Property Office of People's Republic of China on Aug. 15, 2014, which corresponds to Chinese Patent Application No. 201080031554.8 and is related to U.S. Appl. No. 13/532,595; with English language translation, 2014.

The fourth Office Action issued by the State Intellectual Property Office of People's Republic of China on Jan. 7, 2015, which corresponds to Chinese Patent Application No. 201080031554.8 and is related to U.S. Appl. No. 13/532,595; with English language translation, 2015.

* cited by examiner

FIG.7A
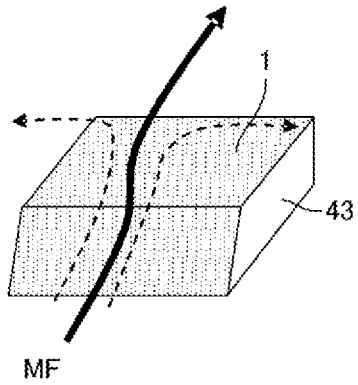
FIG.7B
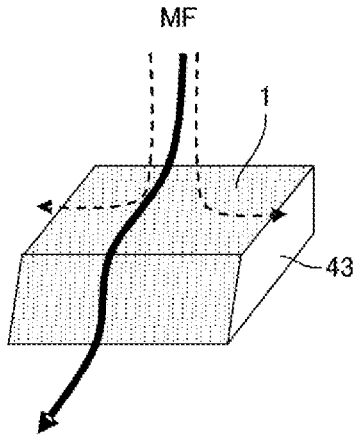
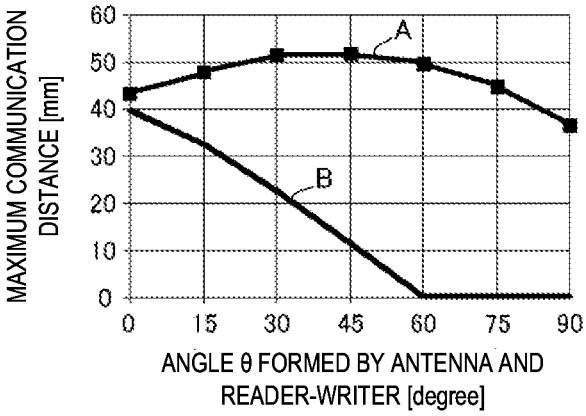
FIG.8

FIG.10A
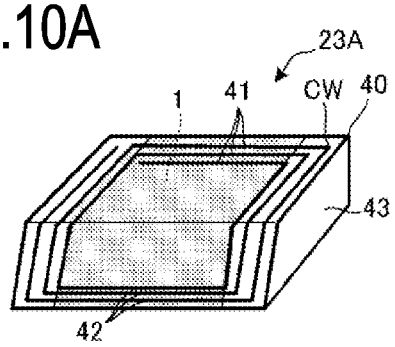
FIG.10B
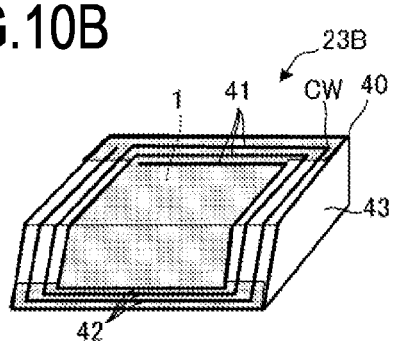
FIG.10C
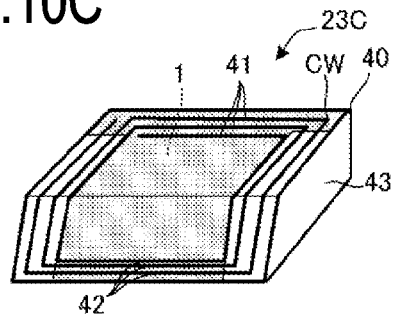
FIG.10D
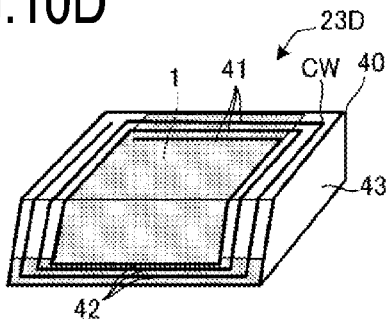
FIG.11
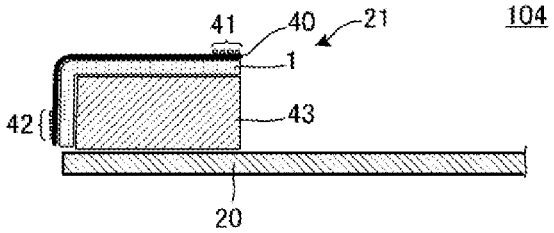
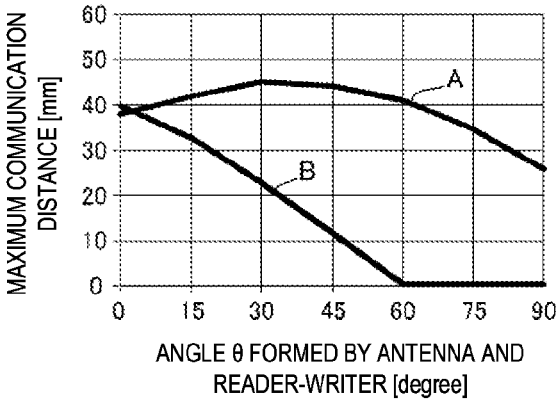
FIG.12

ANTENNA DEVICE AND MOBILE TERMINAL

CROSS REFERENCE TO RELATED APPLICATIONS

The present application is a continuation of International Application No. PCT/JP2010/070768 filed Nov. 22, 2010, which claims priority to Japanese Patent Application No. 2009-291874 filed Dec. 24, 2009, the entire contents of each of these applications being incorporated herein by reference in their entirety.

TECHNICAL FIELD

The present invention relates to an antenna device included in an RFID (radio frequency identification) system or the like that performs communication with external devices via electromagnetic field signals. The present invention also relates to a mobile terminal including the antenna device.

BACKGROUND

Japanese Unexamined Patent Application Publication No. 2003-108966 (PTL 1) discloses an antenna mounted in a mobile electronic device used in the RFID system. FIG. 1 is a sectional view of an antenna disclosed in PTL 1. In FIG. 1, an antenna coil 10 includes a coil body 11 and a core iron member 13. The coil body 11 is a spirally wound conductor disposed on one surface of an insulating film 12. The core iron member 13 is attached to another surface of the insulating film 12 in a layered manner.

SUMMARY

The present disclosure provides an antenna device in which a communication performance that is dependent on an angle formed by the antenna device and a reader-writer antenna is less degraded and a mobile terminal equipped with the antenna device.

In one aspect of the disclosure, an antenna device includes an antenna coil, a flat conductor that is disposed near the antenna coil, the antenna coil including a flexible substrate on which a coil conductor is formed, a magnetic sheet disposed to be in contact with or proximal to the flexible substrate, and a casing that has the antenna coil. The coil conductor is spirally wound and has a conductor opening portion at the center of winding. The antenna coil is disposed near an end portion of the casing. The magnetic sheet is provided between the coil conductor and the flat conductor. The direction from a first conductor portion of the coil conductor that is closer to the center portion of the flat conductor, to a second conductor portion of the coil conductor that is closer to an edge of the flat conductor, bends toward the flat conductor.

In another aspect of the disclosure, a mobile terminal includes the above antenna device and a communication circuit that is housed in the casing.

BRIEF DESCRIPTION OF DRAWINGS

FIG. 7 illustrates operations of a magnetic sheet attached to a support base.

FIG. 8 illustrates a relationship between a maximum communication distance and an angle θ at which a mobile terminal is placed above a reader-writer.

FIG. 10 is a perspective view of antenna coils according to a third exemplary embodiment.

FIG. 11 is a sectional view of an antenna device according to a fourth exemplary embodiment.

FIG. 12 illustrates a relationship between a maximum communication distance and an angle θ at which a mobile terminal is placed above a reader-writer.

DETAILED DESCRIPTION

Figure 1:
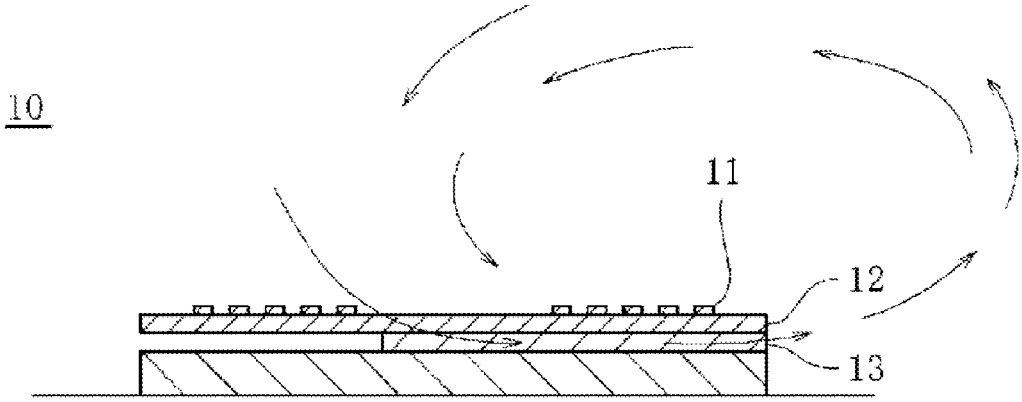
FIG.1 Prior Art
FIG. 1 is a sectional view of an antenna disclosed in PTL 1.
Figure 2:
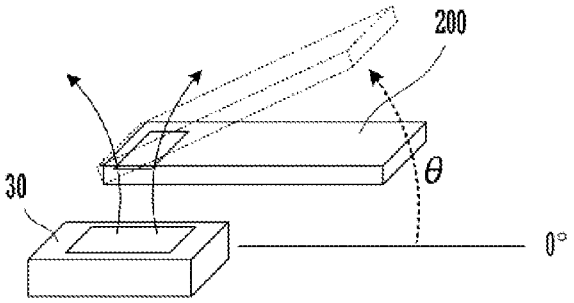
FIG. 2 is a perspective view illustrating an angle θ at which a mobile terminal 200 having an antenna housed in a casing is placed above a reader-writer antenna 30.

The inventors realized that prior art antennas such as the antenna described in PTL 1 can present problems in communication when an angle θ at which a mobile terminal having the antenna housed in a casing is placed above a reader-writer antenna. FIG. 2 is a perspective view that illustrates an angle θ at which a mobile terminal 200 having an antenna housed in a casing is placed above a reader-writer antenna 30.

To perform communication, a magnetic flux has to link with a wound coil. When a magnetic flux enters in a direction that is perpendicular to a flat coil, a large part of the magnetic flux links with the flat coil. On the other hand, when a magnetic flux that enters in a direction that is parallel with a flat coil, scarcely any part of the magnetic flux links with the flat coil, so that no communication can be performed.

An electronic device equipped with the antenna disclosed in PTL 1 forms an angle θ with a reader-writer antenna when placed above the reader-writer. As the angle θ becomes larger, a communicable distance becomes shorter.

Figure 3:
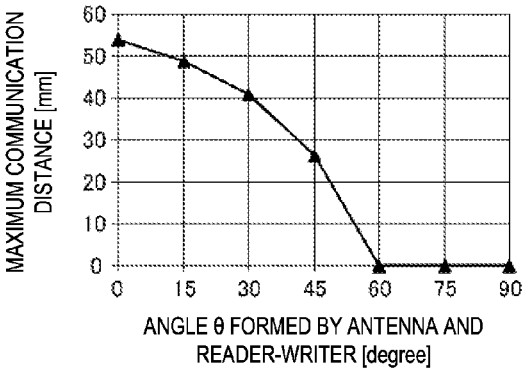
FIG. 3 illustrates a relationship between a communicable distance and an angle θ formed by an electronic device equipped with the antenna disclosed in PTL 1 and a reader-writer antenna.

FIG. 3 illustrates a relationship between a communicable distance and the angle θ formed by the electronic device equipped with the antenna disclosed in PTL 1 and the reader-writer antenna. In this example, a communicable distance is almost zero when the angle θ reaches or exceeds 60°. Thus, no communication can be performed.

The present disclosure provides an antenna device that has less degradation of communication performance as an angle increases between the antenna and a reader-writer antenna device.

Structures of an antenna device and a mobile terminal according to a first exemplary embodiment will now be described with reference to the drawings.

Figure 4A:
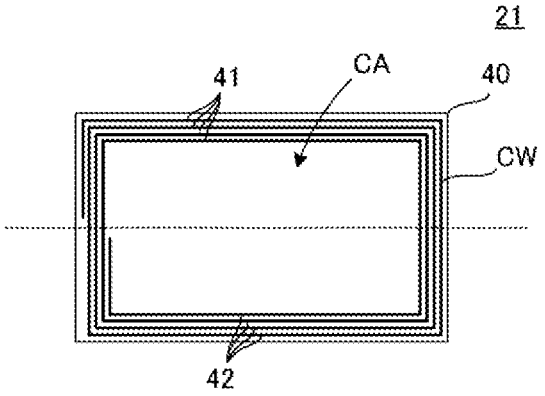
FIG. 4A is a plan view of an antenna device according to a first embodiment and FIG. 4B is a front view of the antenna device.
Figure 4B:
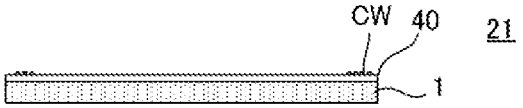

FIG. 4A is a plan view of an antenna coil 21 of an antenna device and FIG. 4B is a front view of the antenna coil 21. The antenna coil 21 includes a flexible substrate 40 on which a coil conductor CW is formed, and a magnetic sheet 1 provided in contact with or proximal to (near) the flexible substrate.

The magnetic sheet 1 can be a rectangular plate-like sheet made of a composite containing a magnetic powder, such as a ferrite powder, and a resin material.

As illustrated in FIG. 4A, a spirally wound coil conductor CW, which has a conductor opening portion CA at the center of winding, is formed on the flexible substrate 40.

In the coil conductor CW, a first conductor portion 41 and a second conductor portion 42 are arranged to face each other across a line passing through the conductor opening portion CA (indicated by a dotted line in the drawing).

Figure 5A:
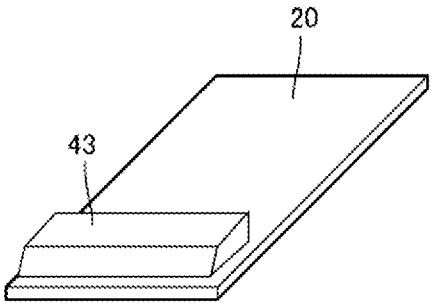
FIG. 5A is a perspective view of a structure of a circuit board on which the antenna device illustrated in FIG. 4 is mounted.
Figure 5B:
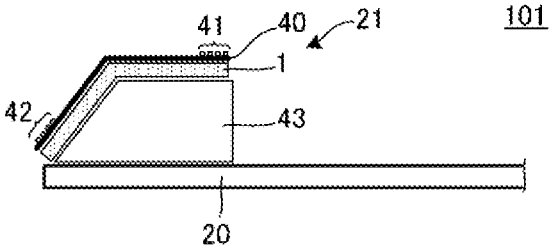
FIG. 5B is a sectional view of a portion of an antenna device according to the first embodiment seen in front.

FIG. 5A is a perspective view illustrating an exemplary structure of a circuit board on which the antenna coil 21 illustrated in FIGS. 4A and 4B can be mounted. FIG. 5B is a sectional view of a portion of the antenna device 101 seen from the front.

Although the antenna device 101 is housed in a casing of a mobile terminal, the casing is not illustrated in FIGS. 5A and 5B.

The antenna device 101 includes an antenna coil 21, a support base 43 that supports the antenna coil 21, and a rectangular plate-like circuit board 20. The antenna coil 21 is attached to the support base 43 illustrated in FIG. 5A.

A ground electrode that extends across one plane is formed on the circuit board 20. This ground electrode is an example of a flat conductor according to the present disclosure.

The antenna coil 21 is provided, or disposed such that the magnetic sheet 1 is closer to the circuit board 20 than is the flexible substrate 40. That is, the magnetic sheet 1 can be provided between the coil conductor and the flat conductor and attached to the support base 43.

As illustrated in FIGS. 5A and 5B, the antenna coil 21 and the support base 43 are arranged near one side of the circuit board 20. Moreover, sides of the antenna coil 21 and the support base 43 that are closer to the one side of the circuit board 20 are bent toward the circuit board. In the example of FIG. 5, the second conductor portion 42 is closer to the one side of the circuit board 20 than is the first conductor portion 41. In other words, the direction from a first conductor portion 41 of the coil conductor that is closer to the center portion of the flat conductor of the circuit board 20, to a second conductor portion 42 of the coil conductor that is closer to an edge of the flat conductor, bends toward the flat conductor. The casing of the mobile terminal can cover at least part of the surface of the antenna coil 21 that is opposite to the side facing the flat conductor of the circuit board 20.

Alternatively, a unit including an antenna coil 21 attached to a support base 43 may be mounted on the circuit board 20. Both ends of the coil conductor of the antenna coil 21 are connected to predetermined terminal electrodes on the circuit board. The connection structure is not illustrated herein. A communication circuit that is connected to the coil conductor of the antenna coil 21 is formed on the circuit board 20.

Figure 6A:
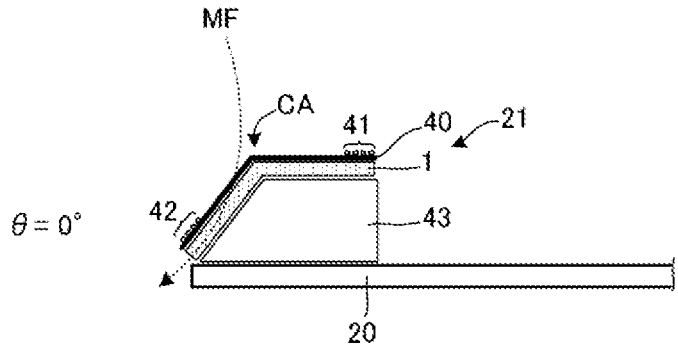
FIG. 6 schematically illustrates how a magnetic flux passes through the coil of the antenna device when an angle θ is changed at which a mobile terminal having the antenna according to the first exemplary embodiment housed in a casing is placed above a reader-writer antenna.
Figure 6B:
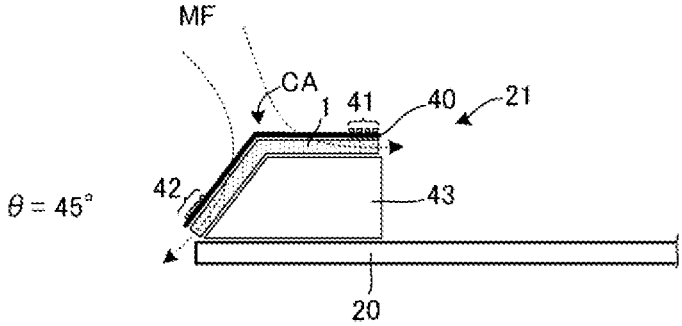
Figure 6C:
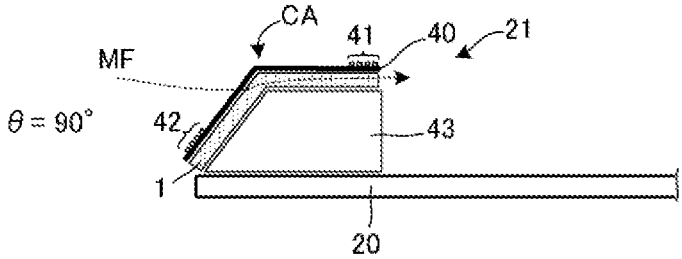

FIGS. 6A, 6B, and 6C schematically illustrate how a magnetic flux passes through the antenna coil when an angle θ is changed at which a mobile terminal having the antenna device according to the first embodiment housed in a casing is placed above a reader-writer antenna. Dotted arrows illustrated in FIGS. 6A, 6B, and 6C schematically indicate paths of magnetic fluxes.

FIG. 6A illustrates a path of a magnetic flux when θ=0°, FIG. 6B illustrates a path of a magnetic flux when θ=45°, and FIG. 6C illustrates a path of a magnetic flux when θ=90°.

When θ=0°, part of a magnetic flux MF of the reader-writer antenna enters from the conductor opening portion CA of the flexible substrate 40, passes through the magnetic sheet 1 toward the second conductor portion 42, and thus links with a coil (a coil that is formed by the coil conductor including the first conductor portion 41 and the second conductor portion 42). Thus, most of the magnetic flux MF exits from a side of the magnetic sheet 1 that is near the second conductor portion 42.

When θ=45°, part of a magnetic flux MF of the reader-writer antenna enters from the conductor opening portion CA of the flexible substrate 40, passes through the magnetic sheet 1 toward the first conductor portion 41, and thus links with the coil. The magnetic flux MF exits from both sides of the magnetic sheet 1 that are near the first conductor portion 41 and the second conductor portion 42.

When θ=90°, part of a magnetic flux MF of the reader-writer antenna enters from the conductor opening portion CA of the flexible substrate 40, passes through the magnetic sheet 1 toward the first conductor portion 41 and the second conductor portion 42, and thus links with the coil. Thus, most of the magnetic flux MF exits from the first conductor portion 41 side of the magnetic sheet 1.

FIGS. 7A and 7B illustrate operations of the magnetic sheet 1 attached to the support base 43. FIG. 7A illustrates a path of a magnetic flux MF that has entered from a side of the magnetic sheet 1 that is near one side of the circuit board when the angle θ is around 90°. FIG. 7B illustrates a path of a magnetic flux MF that has entered the magnetic sheet 1 in the normal direction of the circuit board when the angle θ is around 0°. In both cases, the magnetic flux passes through the magnetic sheet 1 along the magnetic field and thus the magnetic flux that passes through the magnetic sheet links with the coil as illustrated in FIGS. 6A, 6B, and 6C.

FIG. 8 illustrates a relationship between a maximum communication distance and an angle θ at which a mobile terminal is placed above a reader-writer antenna. Herein, a performance line A indicates a performance of an antenna device including the antenna coil 21 according to the first exemplary embodiment and a performance line B indicates a performance of an antenna device according to a comparative example. The antenna device according to the comparative example has no support base, and the whole antenna coil 21 is mounted on the circuit board to be in parallel with the circuit board. The dimensions of the plane projection of the antenna coil 21 according to the first embodiment are 25 mm×15 mm, and the height of the support base is 5 mm. The dimensions of the plane of the antenna device according to the comparative example coil are 25 mm×15 mm.

With the antenna device including the antenna coil of the comparative example, no communication can be performed when the angle θ at which the mobile terminal is placed above the reader-writer is around 60° to 90°, because the communication distance deteriorates. On the other hand, in the case of the antenna device according to the first embodiment, no sudden drops occur when the angle θ at which the mobile terminal is placed above the reader-writer falls in the range of 0° to 90°. Thus, the antenna device according to the first embodiment can secure a large maximum communication distance in a wide angle range.

In this manner, no circumstance where the electromotive force fails to be generated occur as long as the angle θ at which a mobile terminal is placed above a reader-writer antenna is any of 0° to 90°.

FIGS. 9A-9D illustrate a relationship between a range of positions of a magnetic sheet of an antenna device according to a second exemplary embodiment and magnetic fluxes that pass through the magnetic sheet.

Figure 9A:
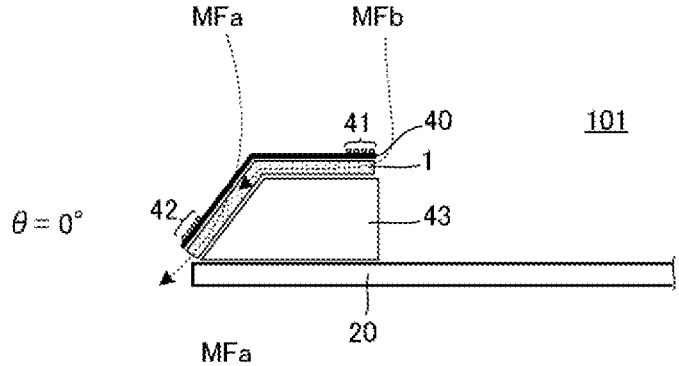
FIG. 9 illustrates relationships between a range of positions of a magnetic sheet of an antenna device according to a second exemplary embodiment and magnetic fluxes that pass through the magnetic sheet.
Figure 9B:
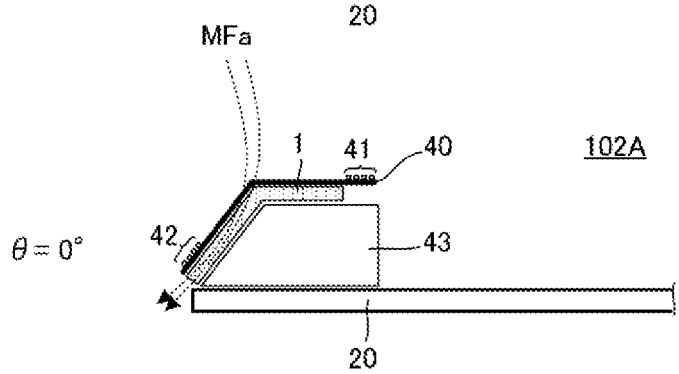
Figure 9C:
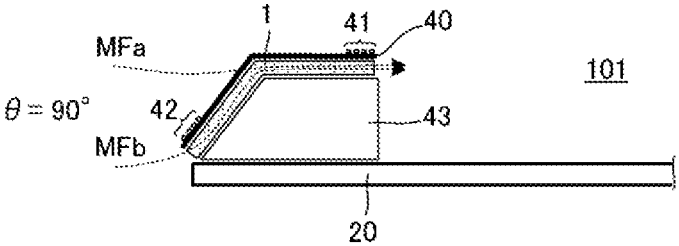
Figure 9D:
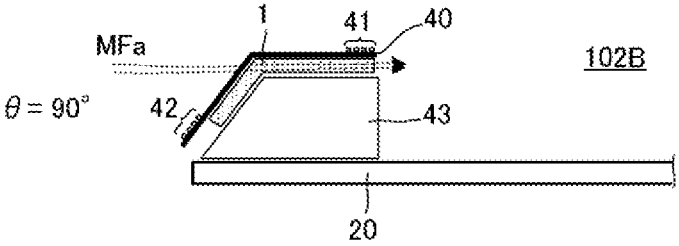

FIG. 9A illustrates the path of a magnetic flux that passes through the antenna device 101 according to the first exemplary embodiment when θ=0°. FIG. 9B illustrates the path of a magnetic flux that passes through an antenna device 102A according to the second exemplary embodiment when θ=0°. FIG. 9C illustrates the path of a magnetic flux that passes through the antenna device 101 according to the first embodiment when θ=90°. FIG. 9D illustrates the path of a magnetic flux that passes through another antenna device 102B according to the second exemplary embodiment when θ=90°.

In the antenna device 101 according to the first exemplary embodiment, the magnetic sheet 1 lies under the entire surface of the flexible substrate 40. When the angle θ is around 0°, a magnetic flux MFb is generated that passes through the magnetic sheet 1 but does not link with the coil as illustrated in FIG. 9A. In the antenna device 102A according to the second exemplary embodiment, one side of the magnetic sheet 1 is positioned so as not to be superposed with (so as to avoid) the first conductor portion 41. Thus, as illustrated in FIG. 9B, passage of the magnetic flux MFb through the magnetic sheet 1 is prevented and the strength of the magnetic flux MFa that contributes to the linkage is increased accordingly.

In the antenna device 101 according to the first exemplary embodiment, when the angle θ is around 90°, a magnetic flux MFb is generated that passes through the magnetic sheet 1 but does not link with the coil as illustrated in FIG. 9C. In the antenna device 102B according to the second exemplary embodiment, one side of the magnetic sheet 1 is positioned so as not to be superposed with (so as to avoid) the second conductor portion 42. Thus, as illustrated in FIG. 9D, passage of the magnetic flux MFb through the magnetic sheet 1 is prevented and the strength of the magnetic flux MFa that contributes to the linkage is increased accordingly.

The antenna device 102A illustrated in FIG. 9B achieves a large maximum communicable distance when the angle θ is in an angle range that is close to 0° (0° to 45°). The antenna device 102B illustrated in FIG. 9D achieves a large maximum communicable distance when the angle θ is in an angle range that is close to 90° (90° to 45°). Thus, the size and the position of the magnetic sheet are determined depending on the angle range regarded as important.

FIGS. 10A, 10B, 10C, and 10D are perspective views of antenna coils 23A, 23B, 23C, and 23D according to a third exemplary embodiment.

In the first exemplary embodiment, the size of the magnetic sheet 1 is the same as the size of the flexible substrate. In the second exemplary embodiment, the magnetic sheet 1 is positioned so as not to be superposed with the first conductor portion 41 or the second conductor portion 42. On the other hand, in the third exemplary embodiment, the magnetic sheet 1 is positioned not to be superposed with conductive portions that are disposed on regions extending along the shorter sides of the magnetic sheet 1.

The magnetic sheet 1 of the antenna coil 23A illustrated in FIG. 10A has a width that is constant from the first conductor portion 41 to the second conductor portion 42. The magnetic sheet 1 of the antenna coil 23B illustrated in FIG. 10B is widened to correspond to the entire width of the flexible substrate 40, at regions at which the first conductor portion 41 and the second conductor portion 42 are formed. The magnetic sheet 1 of the antenna coil 23C illustrated in FIG. 10C is widened to correspond to the entire width of the flexible substrate 40, at a region at which the first conductor portion 41 is formed. The magnetic sheet 1 of the antenna coil 23D illustrated in FIG. 10D is widened so as to correspond to the entire width of the flexible substrate 40, at a region at which the second conductor portion 42 is formed.

An antenna device including the antenna coil 23C illustrated in FIG. 10C achieves a small magnetic reluctance (or enhances an effect of concentrating a magnetic flux) for the case where a magnetic flux passes through a region of the magnetic sheet 1 that is near the first conductor portion 41. Thus, the antenna gain is improved particularly when the angle θ is around 90° as illustrated in FIG. 6C.

An antenna device including the antenna coil 23D illustrated in FIG. 10D achieves a small magnetic reluctance (or enhances an effect of concentrating a magnetic flux) for the case where a magnetic flux passes through a region of the magnetic sheet 1 that is near the second conductor portion 42. Thus, the antenna gain is increased particularly when the angle θ is around 0° as illustrated in FIG. 6A.

An antenna device including the antenna coil 23B illustrated in FIG. 10B achieves a small magnetic reluctance for the cases where a magnetic flux passes through regions of the magnetic sheet 1 that are near the first conductor portion 41 and the second conductor portion 42. Thus, the antenna gain is increased in a wide range of angles θ from 0° to 90° as illustrated in FIGS. 6A, 6B, and 6C.

FIG. 11 is a sectional view of an antenna device 104 according to a fourth exemplary embodiment. The antenna device 104 is housed in a casing of a mobile terminal, but the casing is not illustrated in FIG. 11.

The antenna device 104 includes an antenna coil 21, a support base 43 that supports the antenna coil 21, and a rectangular plate-like circuit board 20. Herein, a rectangular parallelepiped support base 43 is used. Thus, the antenna coil 21 is bent perpendicularly.

FIG. 12 illustrates a relationship between a maximum communication distance and an angle θ at which a mobile terminal is placed above a reader-writer antenna. Herein, a performance line A indicates the performance of the antenna device 104 according to the fourth exemplary embodiment and a performance line B indicates the performance of an antenna device according to a comparative example. The antenna device according to the comparative example has no support base, and the whole antenna coil 21 is mounted on the circuit board to be in parallel with the circuit board. The dimensions of the plane projection of the antenna coil 21 according to the fourth exemplary embodiment are 25 mm×15 mm, and the height of the support base 43 is 5 mm. The dimensions of the plane of the antenna device according to the comparative example coil are 25 mm×15 mm.

With the antenna device including the antenna coil of the comparative example, no communication can be performed when the angle θ at which the mobile terminal is placed above the reader-writer is around 60° to 90°, since the communication distance deteriorates. On the other hand, in the case of the antenna device 104 according to the fourth exemplary embodiment, no sudden drops occur when the angle θ at which the mobile terminal is placed above the reader-writer falls in the range of 0° to 90°. Thus, the antenna device according to the fourth exemplary embodiment can secure a large maximum communication distance in a wide angle range.

In this manner, no circumstance where the electromotive force fails to be generated occur as long as the angle θ at which a mobile terminal is placed above a reader-writer antenna is any of 0° to 90°.

Figure 13A:
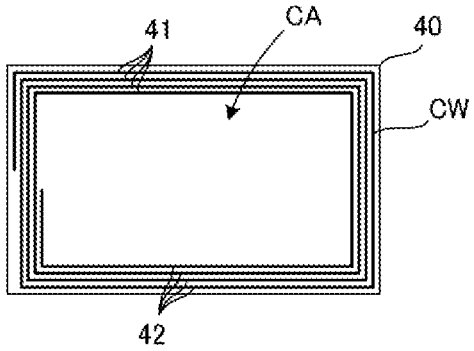
FIG. 13A is a plan view of a flexible substrate included in an antenna device according to a fifth exemplary embodiment and FIG. 13B is a plan view of a magnetic sheet included in the antenna device according to the fifth embodiment.

FIG. 13A is a plan view of a flexible substrate 40 included in an antenna coil according to a fifth exemplary embodiment.

Figure 13B:
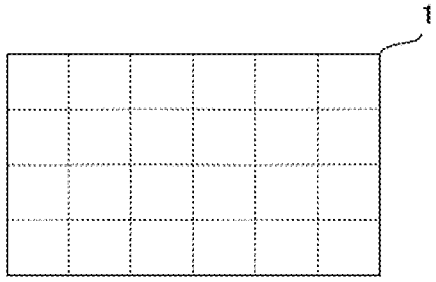

FIG. 13B is a plan view of a magnetic sheet 1 included in the antenna coil according to the fifth exemplary embodiment.

The magnetic sheet 1 illustrated in FIG. 13B is formed in the following manner. A flat ferrite is scored in advance in a grid form, both sides of the ferrite are laminated with films, and the ferrite is divided into multiple pieces to form the magnetic sheet 1. Portions defined by dotted lines in FIG. 13B indicate the pieces of the sintered magnetic substance. This structure allows the whole magnetic sheet 1 to be flexible. Thus, an antenna coil including this magnetic sheet 1 can be easily arranged to follow the surface of a support base. Alternatively, the antenna coil including this magnetic sheet 1 may be arranged to follow the inner surface of a casing of a mobile terminal, for example. In this manner, the antenna coil including the magnetic sheet 1 can be easily mounted in casings of various shapes.

Figure 14:
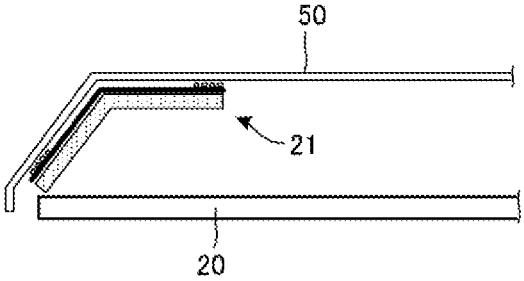
FIG. 14 is a sectional view of a main portion of an antenna device according to a sixth exemplary embodiment.

FIG. 14 is a sectional view of a main portion of an antenna device according to a sixth exemplary embodiment. In the sixth exemplary embodiment, an antenna coil 21 is attached to an inner surface of a casing 50 of a mobile terminal without using a support base. With this structure, the number of components can be reduced and the space generated around the bent portion of the casing can be efficiently used.

In each of the embodiments described above, a ground electrode on a substrate is taken as an example of a flat conductor. However, a shield plate that is attached to a back surface of a liquid crystal display panel, a conductor film or a conductor foil formed on the inner surface of a casing, or even a battery pack may serve as a flat conductor to form an antenna device.

In each of the embodiments described above, an antenna device is disposed inside a casing or on the inner surface of a casing. However, an antenna device may be disposed so as to follow the outer surface of a casing. In this case, part of a flexible substrate of the antenna device may be drawn into the inside of the casing to be electrically connected to a circuit board in the casing.

Embodiments consistent with the present disclosure can effectively link flux between a magnetic flux and a coil conductor in a wide range of angles formed by the antenna device and a reader-writer antenna. Thus, stable communication can be performed in a wide range of angles.

That which is claimed is:

1. An antenna device comprising:

an antenna coil, a flat conductor that is disposed near the antenna coil and a casing, the antenna coil including a flexible substrate on which a coil conductor is formed and a magnetic sheet provided in contact with or proximal to the flexible substrate, wherein the flexible substrate is provided on only one side of the magnetic sheet, wherein the coil conductor is spirally wound and has a conductor opening portion at the center of winding, wherein the antenna coil is disposed near an end portion of the casing, wherein the magnetic sheet is provided between the coil conductor and the flat conductor, and wherein the direction from a first conductor portion of the coil conductor that is closer to the center portion of the flat conductor to a second conductor portion of the coil conductor that is closer to an edge of the flat conductor bends toward the flat conductor.

2. The antenna according to claim 1, wherein the magnetic sheet includes a mixture of a magnetic powder and a resin material formed into a sheet, or a plurality of pieces of a sintered magnetic substance.

3. The antenna according to claim 2, wherein the casing covers at least a part of a surface of the antenna coil that is opposite to the side facing the flat conductor.

4. The antenna device according to claim 3, wherein the flat conductor is a circuit board provided in the casing.

5. The antenna device according to claim 3, wherein the antenna coil is mounted on a support base that holds a shape of the magnetic sheet and a shape of the flexible substrate.

6. The antenna device according to claim 3, wherein the antenna coil is disposed to follow a surface of the casing.

7. A mobile terminal comprising an antenna device according to claim 3 and a communication circuit that is housed in the casing and that allows communication to be performed by use of the antenna device.

8. The antenna device according to claim 2, wherein the antenna coil is mounted on a support base that holds a shape of the magnetic sheet and a shape of the flexible substrate.

9. The antenna device according to claim 2, wherein the antenna coil is disposed to follow a surface of the casing.

10. A mobile terminal comprising an antenna device according to claim 2 and a communication circuit that is housed in the casing and that allows communication to be performed by use of the antenna device.

11. The antenna device according to claim 1, wherein the casing covers at least a part of a surface of the antenna coil that is opposite to the side facing the flat conductor.

12. The antenna device according to claim 11, wherein the flat conductor is a circuit board provided in the casing.

13. The antenna device according to claim 11, wherein the antenna coil is mounted on a support base that holds a shape of the magnetic sheet and a shape of the flexible substrate.

14. The antenna device according to claim 11, wherein the antenna coil is disposed to follow a surface of the casing.

15. A mobile terminal comprising an antenna device according to claim 11 and a communication circuit that is housed in the casing and that allows communication to be performed by use of the antenna device.

16. The antenna device according to claim 1, wherein the antenna coil is mounted on a support base that holds a shape of the magnetic sheet and a shape of the flexible substrate.

17. The antenna device according to claim 1, wherein the antenna coil is disposed to follow a surface of the casing.

18. A mobile terminal comprising an antenna device according to claim 1 and a communication circuit that is housed in the casing and that allows communication to be performed by use of the antenna device.

* * * * *